US010443533B2

(12) United States Patent
Merlino et al.

(10) Patent No.: US 10,443,533 B2
(45) Date of Patent: Oct. 15, 2019

(54) MILD HYBRID POWERTRAIN WITH SIMPLIFIED FUEL INJECTOR BOOST

(71) Applicant: GM Global Technology Operations LLC, Detroit, MI (US)

(72) Inventors: Gennaro Merlino, Turin (IT); Francesco Concetto Pesce, Turin (IT); Roberto Romanato, Settimo Torinese (IT)

(73) Assignee: GM Global Technology Operations LLC, Detroit, MI (US)

( * ) Notice: Subject to any disclaimer, the term of this patent is extended or adjusted under 35 U.S.C. 154(b) by 131 days.

(21) Appl. No.: 15/790,605

(22) Filed: Oct. 23, 2017

(65) Prior Publication Data

US 2019/0120161 A1 Apr. 25, 2019

(51) Int. Cl.

*F02D 41/30* (2006.01)
*F02D 41/20* (2006.01)
*F02M 51/06* (2006.01)

(52) U.S. Cl.

CPC ..... *F02D 41/3005* (2013.01); *F02D 41/20* (2013.01); *F02M 51/061* (2013.01); *F02D 2041/2013* (2013.01); *Y10S 903/906* (2013.01)

(58) Field of Classification Search

CPC ..... F02D 41/20; F02D 41/30; F02D 41/3005; F02D 51/061; F02D 2041/2013

See application file for complete search history.

(56) References Cited

U.S. PATENT DOCUMENTS 5,717,562 A * 2/1998 Antone ..... F02D 41/20 361/155
6,175,484 B1 * 1/2001 Caruthers ..... F02D 41/20 361/154
6,209,513 B1 * 4/2001 Sakasai ..... F02D 41/20 123/299
6,685,160 B2 * 2/2004 Shinogle ..... F02D 41/20 239/96
6,752,226 B2 * 6/2004 Naito ..... B60K 6/485 180/65.26
7,784,445 B2 * 8/2010 Takahashi ..... F02D 41/20 123/479
9,261,038 B2 * 2/2016 Nishida ..... F02D 41/20
9,322,354 B2 * 4/2016 Nishida ..... F02D 41/20
9,593,657 B2 * 3/2017 Kusakabe ..... F02D 41/20
9,835,105 B2 * 12/2017 Yanoto ..... F02D 41/20

(Continued)

*Primary Examiner* — Katy M Ebner
(74) *Attorney, Agent, or Firm* — Quinn IP Law

(57) ABSTRACT

A fuel injection control system is usable with an engine, e.g., a diesel engine of a mild hybrid electric vehicle. The control system includes an auxiliary battery, a high-voltage (HV) battery, e.g., 48 VDC, a switching circuit with first and second switching pairs, a controller, and a fuel injector system. The controller opens and closes the switches to command an electrical current from the auxiliary or HV battery according to a predetermined injector current profile. The fuel injector system has one or more control solenoids. Windings of the solenoids are electrically connectable to the HV battery during a boost phase of the profile via opening of the first switching pair and closing of the second switching pair, and to the auxiliary battery during peak, by-pass, hold, and end-of-injection phases of the profile via closing of the first switching pair and opening of the second switching pair.

20 Claims, 2 Drawing Sheets

(56) References Cited

U.S. PATENT DOCUMENTS

| | | | | |
|---|---|---|---|---|
| 9,835,108 | B2 * | 12/2017 | Nishimura | F02D 41/20 |
| 9,926,874 | B2 * | 3/2018 | Kusakabe | F02D 41/20 |
| 10,082,125 | B2 * | 9/2018 | Fujimoto | F02P 17/00 |
| 10,161,339 | B2 * | 12/2018 | Kusakabe | F02D 41/20 |
| 10,197,002 | B2 * | 2/2019 | Tanaka | F02D 41/20 |
| 2015/0377173 | A1 * | 12/2015 | Tritsch | F02D 41/20 123/476 |
| 2016/0208724 | A1 * | 7/2016 | Melis | F02D 41/20 |
| 2017/0051696 | A1 * | 2/2017 | Mukaihara | F02D 41/20 |
| 2017/0335789 | A1 * | 11/2017 | Kiuchi | F02D 41/20 |
| 2018/0017005 | A1 * | 1/2018 | Kusakabe | F02D 41/20 |
| 2018/0023503 | A1 * | 1/2018 | Kimura | F02D 41/20 701/104 |
| 2018/0156148 | A1 * | 6/2018 | Nishimura | F02D 41/20 |
| 2018/0306137 | A1 * | 10/2018 | Yamaoka | F02D 41/20 |
| 2018/0320620 | A1 * | 11/2018 | Satake | F02D 41/20 |
| 2018/0363608 | A1 * | 12/2018 | Kusakabe | F02M 45/12 |

* cited by examiner

MILD HYBRID POWERTRAIN WITH SIMPLIFIED FUEL INJECTOR BOOST

INTRODUCTION

A conventional powertrain of a vehicle or a power plant uses an internal combustion engine to generate torque, with the engine coupled to a driven load via a power transmission arrangement. In lieu of an engine, an electric powertrain relies on electrical energy supplied by a multi-cell battery pack, a fuel cell stack, or another direct current (DC) power supply. Hybrid powertrains generate torque using either or both of an engine and an electric machine as prime movers, with operation of the prime movers determined and closely regulated by a hybrid controller in order to achieve optimal drive performance or fuel economy.

Of the above-noted powertrains, a hybrid powertrain in particular may be configured as a full/strong-type or a mild hybrid-type of powertrain. In a strong hybrid powertrain, motor output torque from one or more high-voltage electric machines is used as a primary source of torque in order to propel the vehicle. In contrast, a mild hybrid powertrain uses an electric machine to provide increased torque for cranking and starting the engine, e.g., after an idle fuel-conserving engine auto-stop event. Additionally, transient torque pulses may be delivered by the electric machine to the engine during engine auto-start/auto-stop events, as well as to reduce engine load as needed for optimal drive performance. The transient torque boost provided by the electric machine in a mild hybrid powertrain is intended to improve engine acceleration performance and starting time relative to an auxiliary starter motor.

SUMMARY

A fuel injection control system is disclosed herein for use with an internal combustion engine, for instance with a diesel engine within a mild hybrid powertrain. In an example embodiment, the control system includes an auxiliary battery providing an auxiliary output voltage, a high-voltage (HV) battery providing an HV output voltage that is greater than the auxiliary output voltage, a switching circuit, a controller, and a fuel injector system. The switching circuit includes first and second switching pairs. The controller commands the opening and closing of individual switches of the switching pairs in order to inject an electrical current from a selected one of the auxiliary battery or the HV battery according to a predetermined injector current profile. The fuel injector system includes one or more control solenoids configured to control an injection of fuel into the engine's cylinders.

The control solenoids include wire coils or windings that are electrically connectable to the HV battery during a transient boost phase of the injector current profile, with connection to the HV battery occurring via opening of the switches of the first switching pair and closing of the switches of the second switching pair. The solenoid windings are electrically connectable to the auxiliary battery during separate peak, by-pass, hold, and end-of-injection phase of the fuel injection profile, which is accomplished by closing the first switching pair and opening the second switching pair.

The HV output voltage may be at least 48 VDC in some embodiments, such as when the engine is used as part of a mild hybrid electric powertrain.

The switching pairs may include a corresponding high-side switch that selectively connects the control solenoid(s) to the HV or auxiliary battery, with the particular battery based on the injector current profile, and a low-side switch selectively connecting the control solenoid(s) to electrical ground. The switching pairs may be optionally embodied as solid-state semiconductor switches.

The switching circuit may include a first diode having anode and cathode sides. The anode side is connected to electrical ground. The cathode side is connected to the high-side switches. A second diode has an anode side connected to the low-side switches and a cathode side connected to the HV battery.

A plurality of the control solenoids may be arranged in electrical parallel with respect to each other.

A vehicle is also disclosed herein that includes an internal combustion engine and the fuel injection control system noted above. The vehicle may include an electric machine that is electrically connected to the HV battery and powered by the HV output voltage. The vehicle may be optionally embodied as a mild hybrid electric vehicle, in which case motor output torque from the electric machine may be used to crank and start the engine.

The above summary does not represent every embodiment or every aspect of the present disclosure. Rather, the foregoing summary merely provides an exemplification of some of the novel concepts and features set forth herein. The above features and advantages, and other features and advantages of the present disclosure, will be readily apparent from the following detailed description of illustrative embodiments and representative modes for carrying out the present disclosure when taken in connection with the accompanying drawings and the appended claims. Moreover, this disclosure expressly includes any and all combinations and subcombinations of the elements and features presented above and below.

Figure 1:
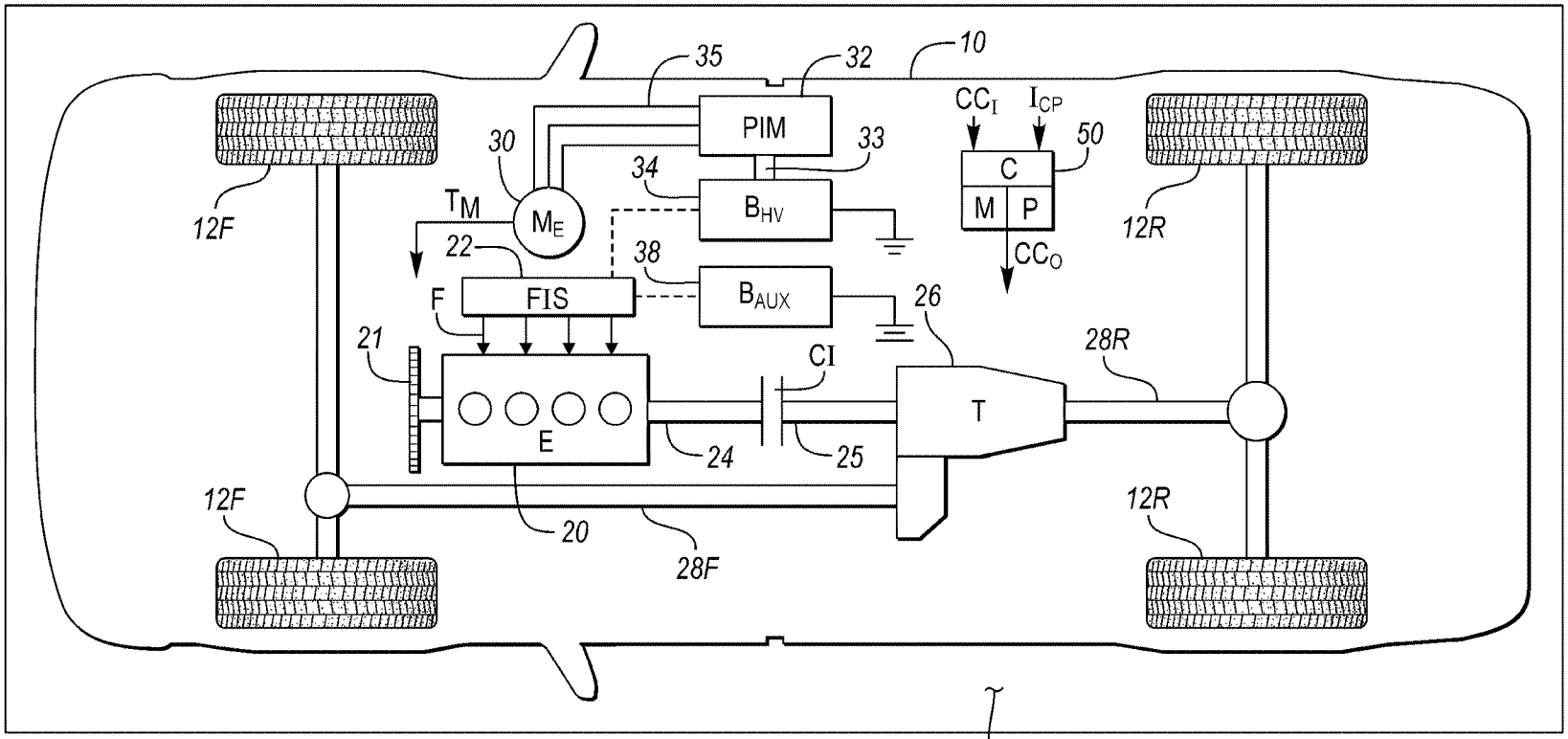
FIG. 1 is a schematic illustration of an example vehicle having mild hybrid electric powertrain with an injection control system of the type disclosed herein.

The present disclosure is susceptible to various modifications and alternative forms, and some representative embodiments have been shown by way of example in the drawings and will be described in detail herein. It should be understood, however, that the novel aspects of this disclosure are not limited to the particular forms illustrated in the drawings. Rather, the disclosure is to cover all modifications, equivalents, combinations, and alternatives falling within the spirit and scope of the disclosure as defined by the appended claims.

DETAILED DESCRIPTION

Referring to the drawings, wherein like reference numbers refer to like components throughout the several views, FIG. 1 depicts a schematic example vehicle 10 having an internal combustion engine (E) 20 that is supplied by fuel (arrows F) from a fuel injector system (FIS) 22. The vehicle 10 may be configured as a motor vehicle as shown, and therefore may be equipped with respective front and rear wheels 12F and 12R in rolling contact with a road surface 14. The example embodiment of a motor vehicle 10 having a diesel fuel-powered engine 20 used as part of a mild hybrid system will be described hereinafter for illustrative consistency. However, while such a vehicle 10 is an example of a type of system potentially benefitting from the present FIS 22, other fuel types such as gasoline or biodiesel, ethanol, or other alternative fuels may be readily envisioned within the scope of the disclosure, including but not limited to stationary power plants, mobile platforms, and various land, air, or marine vehicles.

The engine 20 may include a flywheel 21 and a crankshaft 24. The crankshaft 24 is selectively connected to an input member 25 of a transmission (T) 26 via an input clutch CI. When the engine 20 is supplied by fuel (arrows F) from the FIS 22, engine torque is delivered to the transmission 26 via the coupled crankshaft 24 and input member 25. In response, the transmission 26 delivers output torque to the wheels 12F and/or 12R via a corresponding drive axle 28F or 28R, respectively.

The vehicle 10 may include an electric machine ($M_E$) 30, such as a polyphase electric machine having a rotatable output shaft (not shown). When the electric machine 30 is energized via application of a polyphase voltage (VAC) to individual phase windings 35 of the electric machine 30, motor output torque (arrow $T_M$) is ultimately generated and delivered to a coupled load. The flywheel 21 may act as a coupled load in a mild hybrid powertrain arrangement in which the engine 20 is cranked and started using the motor output torque (arrow $T_M$). The electric machine 30 may be coupled to the engine 20 via a belted drive connection (not shown). Other possible implementations include connecting the electric machine 30 to the crankshaft 24, to the input member 25 of the transmission 26, to a gear member or drive element located within the transmission 26, or on one or both of the drive axles 28F and/or 28R. Therefore, the specific configuration of FIG. 1 is intended as a non-limiting example embodiment.

The electric machine 30 may be optionally embodied as a three-phase/multi-phase traction motor or a motor/generator unit, with tensioners (not shown) accommodating torque in both rotational directions when the electric machine 30 is embodied as a motor/generator unit. The phase windings 35 carry a corresponding phase current in the depicted polyphase configuration. In various example embodiments, the electric machine 30 may be constructed as an induction machine or as a synchronous machine with or without permanent magnets within its rotor, without limitation.

The vehicle 10 of FIG. 1 may also include a power inverter module (PIM) 32, a high-voltage battery ($B_{HV}$) 34, and an auxiliary voltage battery ($B_{AUX}$) 38. As used herein, the term "auxiliary voltage" refers to 12-15 VDC voltage levels typically used to power lighting devices, instrument panels, and other auxiliary systems within or external to the vehicle 10. The term "high-voltage" refers to voltage levels in excess of such auxiliary levels, with 48 VDC being suitable for powering mild hybrid operations. The auxiliary and high-voltage levels may be maintained over separate voltage networks as shown. The high-voltage and auxiliary batteries 34 and 38 of FIGS. 1 and 3 may include a plurality of battery cells (not shown), such as rechargeable lithium-ion or nickel cadmium cells arranged in a stack for the high-voltage battery 34 and lead-acid battery cells for the auxiliary battery 38. The number, chemical composition, configuration, and arrangement of such battery cells may vary with the intended application.

The PIM 32, which is electrically connected to the phase windings 35 of the electric machine 30, includes switching pairs of upper/high-side and lower/low-side switches, with the terms "upper" and "high-side" referring to connection to a voltage source, i.e., the auxiliary battery 38 or HV battery 34, and "lower" or "low-side" referring to connection at a lower potential/electrical ground (GND). The semiconductor switches (not shown) of the PIM 32, as understood in the art, may be embodied as voltage-controlled, bipolar solid-state switches, e.g., insulated gate bipolar transistors (IGBTs), metal-oxide semiconductor field effect transistors (MOSFETs), wideband GaN devices (WBG), or other suitable switches having a corresponding gate to which a gate signal is applied to change the on/off state of a given switch.

A controller (C) 50 is in communication with the PIM 32 and the FIS 22 over a controller area network or other communication bus, and may be variously configured as a single device or as distributed control devices. Although omitted from FIG. 1, connectivity of the controller 50 to the PIM 32 may include transfer conductors and/or wireless control links or paths suitable for transmitting and receiving control signals (arrow $CC_O$) in response to a set of input signals (arrow $CC_I$). In controlling the FIS 22 as set forth herein, the controller 50 may also receive or be programmed with a predetermined injector current profile (arrow $I_{CP}$) defining a desired voltage profile for regulation of a current injection process into control solenoids of the FIS 22, shown in FIG. 3 as control solenoids 22A and 22B arranged in electrical parallel with respect to each other. The injector current profile (arrow $I_{CP}$) and the control solenoids 22A and 22B are described in more detail below with reference to FIGS. 2 and 3, respectively.

Figure 3:
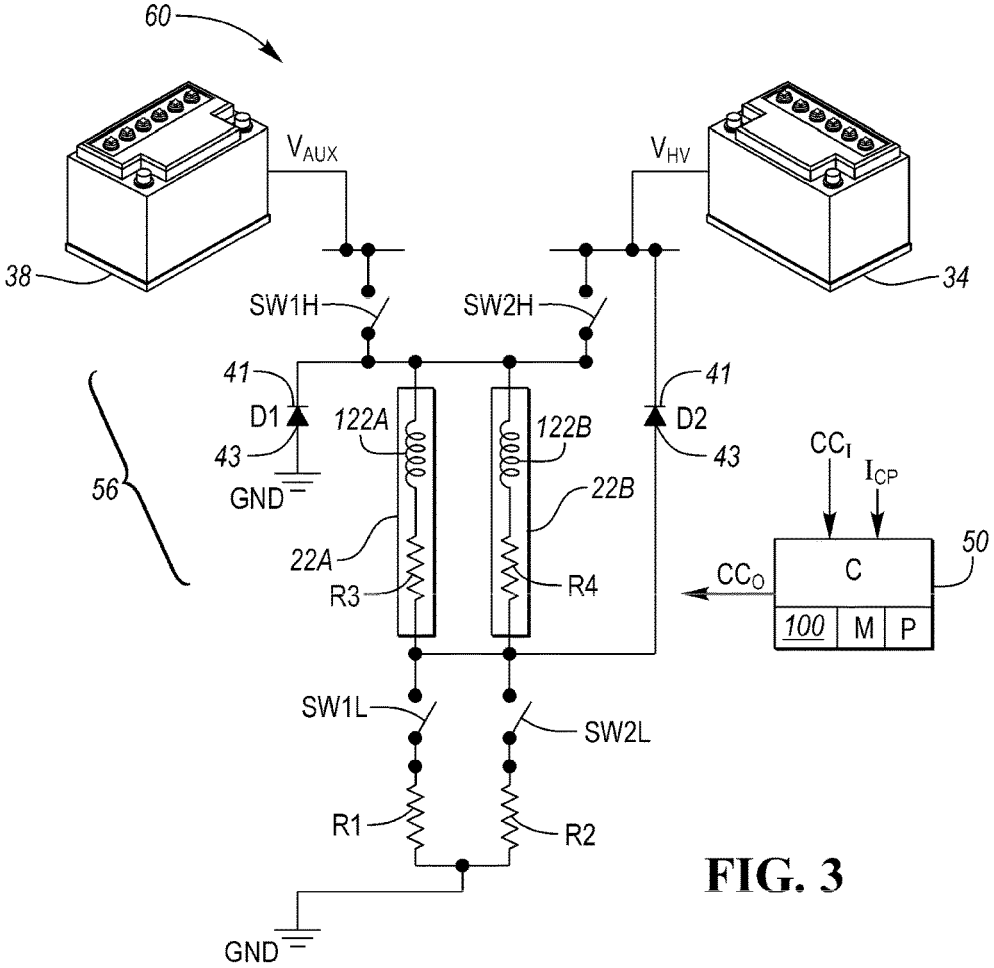
FIG. 3 is schematic illustration of the injection control system according to an example embodiment.

The controller 50 shown in FIGS. 1 and 3 may include a processor (P) and tangible, non-transitory memory (M), including read only memory in the form of optical, magnetic, or flash memory. The controller 50 may also include sufficient amounts of random access memory and electrically-erasable programmable read only memory, as well as a high-speed clock, analog-to-digital and digital-to-analog circuitry, and input/output circuitry and devices, as well as appropriate signal conditioning and buffer circuitry. Computer-readable instructions 100 may be recorded in the memory (M), with execution of such instructions 100 causing the controller 50 to regulate operation of the FIS 22 according to the injector current profile (arrow $I_{CP}$) to ensure delivery of fuel (arrows F) to the engine 20.

Referring briefly to FIG. 3, solenoid-controlled fuel injectors, as will be understood by those of ordinary skill in the art, may deliver the high-pressure fuel (arrows F) to individual cylinders of the example engine 20 of FIG. 1. Field windings 122A and 122B of the respective control solenoids 22A and 22B shown in FIG. 3 are thus energized by an electrical current from the high-voltage battery 34 or the auxiliary battery 38 in order to generate an electromagnetic field. The field generation process results in translation of a plunger (not shown) disposed within a solenoid body of the control solenoids 22A and 22B. A small calibrated volume of the fuel (arrows F) escapes from the solenoid body due to such field-based plunger movement, which in turn creates a pressure differential within the solenoid body. As a result of the pressure differential, a needle or pintle moves away from a nozzle seat and allows diesel fuel to be injected at high pressure into a cylinder of the engine 20.

Figure 2:
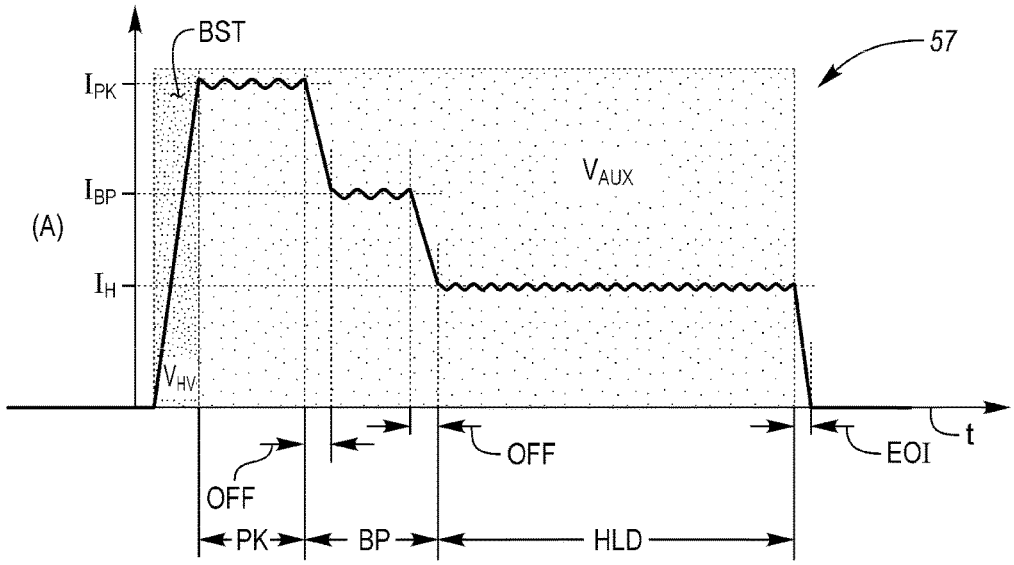
FIG. 2 is a schematic injector current profile usable with the vehicle of FIG. 1, with time depicted on the horizontal axis and current in amperes depicted on the vertical axis.

Referring to FIG. 2, injection of electrical current into the field windings 122A and 122B of FIG. 3 occurs according to a predetermined injector current profile 57 corresponding to arrow $I_{CP}$ in FIG. 1. A complete cycle of the injector current profile 57 includes a boost phase (BST) in which the electrical current is delivered to the field windings 122 via the high-voltage battery 34, which occurs in lieu of a separate high-voltage DC-DC converter or ASIC-controlled output voltage. In other words, the example fuel injector control system 60 of FIG. 3 is characterized by an absence of a DC-DC converter. After the boost phase (BST) is completed, the electrical current is supplied solely by the auxiliary battery 38 in progressive injection control phases, i.e., a peak phase (PK), a by-pass phase (BP), a hold phase (HLD), and an end-of-injection (EOI) phase, as those terms are understood in the art. The actual voltage level required for completion of the boost phase (BST) may vary with the construction of the control solenoids 22A and 22B of FIG. 2. However, the boost voltage range may be about 48-52 VDC, and therefore synergies may exist when using the FIS 22 of FIG. 1 in a mild hybrid powertrain configuration in which the high-voltage battery 34 of FIGS. 1 and 3 is used as part of an architecture for cranking and starting the engine 20.

During the boost phase (BST) shown in FIG. 2, the injector current starts at 0 amps and quickly ramps up in a linear manner to a predetermined peak current ($I_{PK}$) magnitude. Upon reaching the peak current ($I_{PK}$) magnitude, the controller 50 discontinues feeding of the electrical current from the HV battery 34 and commences feeding of the electrical current from the auxiliary battery 38. That is, the HV battery 34 is used to provide the injector current in FIG. 2 during the boost phase (BP) because a relatively high energy level is required during the boost phase (BP) so as to unbalance the control chamber equalization forces within the control solenoids 22A and 22B shown in FIG. 3. In turn, the unbalanced forces allow a needle (not shown) within the control solenoids 22A and 22B to begin to translate within the control solenoids 22A and 22B and unblock pressurized fuel (arrow F), as noted above. The peak current ($I_{PK}$) is held steady for a calibrated duration through the peak phase (PK) before the electrical current from the auxiliary battery 38 is switched off. The electrical current then ramps down in a linear manner to a predetermined by-pass current ($I_{BP}$) magnitude, and is thereafter turned on and held for a calibrated duration through the by-pass phase (BP).

At the conclusion of the by-pass phase (BP), the electrical current from the auxiliary battery 38 of FIGS. 1 and 2 is once again turned off. In response, the injector current ramps down in a linear manner to a predetermined hold current (HC) magnitude, and is thereafter turned on and held steady for a calibrated duration through the hold phase (HC). The end of the hold phase (HC) results in discontinuation of the injector current, such that the injector current profile 57 ramps down in a linear manner to 0 amps in the end-of-injection (EOI) phase. The injector current profile 57 then repeats, with the possibility of multiple identical injector current profiles 55 being executed in series to complete one full injection cycle within the engine 20 of FIG. 1.

FIG. 3 depicts an example embodiment of the injection control system 60. As shown, the injection control system 60 includes the auxiliary battery 38 and the HV battery 34, as well as the control solenoids 22A and 22B, all of which are shown schematically and not to scale. The controller 50 is in communication with a switching circuit 56, e.g., wirelessly or over transfer conductors, such that the control signals (arrow $CC_O$) serve to open or close upper/high-side switches SW1H and SW2H and lower/low-side switches SW1L and SW2L at predetermined times, doing so according to the injector current profile 57 of FIG. 2.

Further with respect to the switching circuit 56, the control solenoids 22A and 22B are connected via the high-side switches SW1H and SW2H to one of the HV battery 34 providing a high-voltage level ($V_{HV}$) and auxiliary battery 38 providing an auxiliary-voltage level ($V_{AUX}$). First and second diodes D1 and D2 may be used to protect the switching circuit 56 from reverse current flow, with the internal resistance of the control solenoids 22A and 22B represented by a respective series resistor R3 and R4. The first diode D1 may have an anode side 43 connected to electrical ground (GND) and a cathode side 41 connected to the high-side switches SW1H and SW2H. The second diode D2 has an anode side 41 connected to the low-side switches SW1L and SW2L and a cathode-side 43 connected to the HV battery 34. Current-limiting resistors R1 and R2 may be connected in series with the respective control solenoids 22A and 22B as shown.

Control of the switching circuit 56 is regulated by the controller 50. During the boost phase (BST) of FIG. 2, for instance, the HV battery 34 is electrically connected to the control solenoids 22A and 22B via a commanded closing of switches SW2H and SW2L. At the same time, the auxiliary battery 34 is electrically disconnected from the control solenoids 22A and 22B by the opening of switches SW1H and SW1L. Upon completion of the boost phase (BST), i.e., when the peak current ($I_{PK}$) is achieved, the controller 50 connects the auxiliary battery 38 to the control solenoids 22A and 22B via a commanded closing of the switches SW1H and SW1L. At the same time, the controller 50 disconnects the HV battery 34 from the control solenoids 22A and 22B by opening the switches SW2H and SW2L. The auxiliary battery 38 thereafter powers the switching circuit 56 through the remainder of the peak (PK), by-pass (BP), hold (HLD), and end-of-injection (EOI) phases depicted schematically in FIG. 2.

The FIS 22 and vehicle 10 described above enable a relatively low-cost implementation of a solenoid-controlled high-pressure fuel injection process, for instance within a 48 VDC mild hybrid powertrain. Attendant benefits of the disclosed boost architecture include improved thermal dissipation, control complexity, and architecture simplification. As the injection control system 60 of FIG. 3 is characterized by an absence of a DC-DC boost converter circuit or related ASIC structure dedicated to providing the requisite boost energy, the resultant configuration is simplified with reduced packaging requirements.

While aspects of the present disclosure have been described in detail with reference to the illustrated embodiments, those skilled in the art will recognize that many modifications may be made thereto without departing from the scope of the present disclosure. The present disclosure is not limited to the precise construction and compositions disclosed herein; modifications, changes, and/or variations apparent from the foregoing descriptions are within the scope of the disclosure as defined in the appended claims. Moreover, the present concepts may expressly include combinations and sub-combinations of the preceding elements and features.

What is claimed is:

1. A fuel injection control system for use with an internal combustion engine, the fuel injection control system comprising:

an auxiliary battery configured to generate an auxiliary output voltage;

a high-voltage (HV) battery configured to generate an HV output voltage that is greater than the auxiliary output voltage;

a switching circuit including a first switching pair of switches and a second switching pair of switches distinct from the first switching pair of switches;

a controller configured to open and close the switches of the first and second switching pairs to thereby command input of electrical current from the auxiliary battery and the HV battery according to a predetermined injector current profile; and a fuel injector system having a control solenoid electrically connected to the switches of both the first and second switching pairs and configured to control an injection of fuel into the engine, the control solenoid including field windings that are electrically connectable to:

the HV battery during a boost phase of the injector current profile via opening of both of the switches of the first switching pair and closing of both of the switches of the second switching pair; and the auxiliary battery during each of a peak, by-pass, hold, and end-of-injection phase of the predetermined injector current profile via closing of both of the switches of the first switching pair and opening of both of the switches of the second switching pair.

2. The fuel injection control system of claim 1, wherein the HV output voltage is at least 48 VDC.

3. The fuel injection control system of claim 1, wherein the switches of the first switching pair include: a first high-side switch selectively connecting the control solenoid to the auxiliary battery and a first low-side switch selectively connecting the control solenoid to electrical ground.

4. The fuel injection control system of claim 3, wherein the switches of the second switching pair include: a second high-side switch selectively connecting the control solenoid to the HV battery, and a second low-side switch selectively connecting the control solenoid to electrical ground.

5. The fuel injection control system of claim 4, wherein the switching circuit further includes: a first diode having an anode side connected to electrical ground and a cathode side connected to the first high-side switch; and a second diode having an anode side connected to the second low-side switch and a cathode side connected to the HV battery.

6. The fuel injection control system of claim 1, wherein the switches of the first and second switching pairs are solid-state switches.

7. The fuel injection control system of claim 1, wherein the control solenoid includes a plurality of control solenoids arranged in electrical parallel with respect to each other.

8. The fuel injection control system of claim 1, wherein the switching circuit further includes: a first resistor connected in electrical series with the switches of the first switching pair; and a second resistor connected in electrical series with the switches of the second switching pair.

9. The fuel injection control system of claim 1, wherein the switching circuit comprises:

the switches of the first switching pair having a first high-side switch connected in series with the control solenoid and the auxiliary battery, and a first low-side switch connected in electrical series with the first high-side switch, the control solenoid, and electrical ground;

the switches of the second switching pair having a second high-side switch connected in series with the control solenoid and the HV battery, and a second low-side switch connected in electrical series with the first high-side switch, the control solenoid, and the electrical ground;

a first resistor connected in series between the first low-side switch and the electrical ground;

a second resistor connected in series between the second low-side switch and the electrical ground;

a first diode connected in series between the first high-side switch and the electrical ground; and a second diode connected in series between the second low-side switch and the HV battery.

10. A vehicle comprising:

an internal combustion engine;

a fuel injection control system in operative communication with the internal combustion engine, the fuel injection control system including:

an auxiliary battery configured to generate an auxiliary output voltage;

a high-voltage (HV) battery configured to generate an HV output voltage that is greater than the auxiliary output voltage;

a switching circuit including a first switching pair of switches and a second switching pair of switches distinct from the first switching pair of switches; and a controller configured to open and close the first and second switching pairs to thereby command input of electrical current from the auxiliary battery and the HV battery according to a predetermined injector current profile; and a fuel injector system having a control solenoid electrically connected to the switches of both the first and second switching pairs and configured to control an injection of fuel into the engine, the control solenoid including field windings that are electrically connectable to:

the HV battery during a boost phase of the injector current profile via opening both of the switches of the first switching pair and closing both of the switches of the second switching pair; and the auxiliary battery during each of a peak, by-pass, hold, and end-of-injection phase of the predetermined injector current profile via closing both of the switches of the first switching pair and opening both of the switches of the second switching pair.

11. The vehicle of claim 10, further comprising an electric machine that is electrically connected to the HV battery and powered by the HV output voltage.

12. The vehicle of claim 10, wherein the engine is a diesel engine and the fuel is diesel fuel.

13. The vehicle of claim 10, wherein the HV output voltage is at least 48 VDC.

14. The vehicle of claim 10, wherein each of the first and second switching pairs includes a high-side switch selectively connecting the control solenoid to the HV battery or the auxiliary battery, and a low-side switch selectively connecting the control solenoid to electrical ground.

15. The vehicle of claim 14, wherein the first and second switching pairs are solid-state switches.

16. The vehicle of claim 14, wherein the switching circuit further includes: a first diode having an anode side connected to electrical ground and a cathode side connected to the high-side switch of the first switching pair and the high-side switch of the second switching pair; and a second diode having an anode side connected to the low-side switch of the first switching pair and the low-side switch of the second switching pair, and a cathode side connected to the HV battery.

17. The vehicle of claim 10, wherein the control solenoid includes a plurality of control solenoids arranged in electrical parallel with respect to each other.

18. A mild hybrid-electric vehicle comprising:

a diesel engine;

an electric machine energized by a high-voltage (HV) output voltage and configured to deliver a motor torque to crank and start the diesel engine during an engine auto-start event;

a fuel injection control system in operative communication with the diesel engine, the fuel injection control system including:

an auxiliary battery configured to generate an auxiliary output voltage of 12-15 VDC;

a high-voltage (HV) battery configured to generate the HV output voltage at a level of at least 48 VDC;

a switching circuit having a first switching pair of switches and a second switching pair of switches distinct from the first switching pair of switches; and a controller configured to open and close the first and second switching pairs according to a predetermined injector current profile; and a fuel injector system having first and second control solenoids arranged in electrical parallel with respect to each other, each being configured to control an injection of diesel fuel into the engine, and each having field windings that are electrically connectable to:

the HV battery during a boost phase of the injector current profile via opening both of the switches of the first switching pair and closing both of the switches of the second switching pair, and the auxiliary battery during each of a peak, by-pass, hold, and end-of-injection phase of the predetermined injector current profile via closing both of the switches of the first switching pair and opening both of the switches of the second switching pair;

wherein each of the first and second switching pairs includes a high-side switch selectively connecting a corresponding one of the first and second control solenoids to the HV battery or the auxiliary battery, and a low-side switch selectively connecting a corresponding one of the control solenoids to electrical ground.

19. The vehicle of claim 18, wherein the first and second switching pairs are solid-state switches.

20. The vehicle of claim 18, wherein the switching circuit further includes: a first diode having an anode side connected to electrical ground and a cathode side connected to the high-side switches; and a second diode having an anode side connected to the low-side switches and a cathode side connected to the HV battery.

* * * * *